United States Patent [19]

Hinson

[11] Patent Number: 4,817,412

[45] Date of Patent: Apr. 4, 1989

[54] UNIBODY LIFTING AND ANCHORING ASSEMBLY

[76] Inventor: Virgil H. Hinson, 206 Fairway Oaks Dr., Brunswick, Ga. 31520

[21] Appl. No.: 111,855

[22] Filed: Oct. 23, 1987

[51] Int. Cl.[4] ..... B21D 1/12

[52] U.S. Cl. ..... 72/305; 72/705; 254/93 HP

[58] Field of Search ..... 254/89 H, 90, 93 HP; 72/305, 705

[56] References Cited

U.S. PATENT DOCUMENTS

| | | | |
|---|---|---|---|
| 3,754,427 | 8/1973 | Hunnicutt . | |
| 4,050,287 | 9/1977 | Borup . | |
| 4,087,895 | 5/1978 | Etienne . | |
| 4,286,490 | 9/1981 | Spengler . | |
| 4,319,666 | 3/1982 | Hunter | 254/89 H |
| 4,323,141 | 4/1982 | Ragan . | |
| 4,463,937 | 8/1984 | Celette | 72/705 |
| 4,516,423 | 5/1985 | Reich | 72/705 |
| 4,542,636 | 9/1985 | Wright | 72/705 |
| 4,586,359 | 5/1986 | Parks | 72/705 |
| 4,603,570 | 8/1986 | Dehn . | |
| 4,605,203 | 8/1986 | Hooper . | |

*Primary Examiner*—Lowell A. Larson

*Attorney, Agent, or Firm*—Fleit, Jacobson, Cohn & Price

[57] ABSTRACT

A horizontally elongated lifting and anchoring assembly (to be used in pairs) for transverse disposition beneath a vehicle body to be engaged and lifted relative to a floor surface, the assembly being floor mounted for lateral shifting relative thereto. The assembly includes an upper elongated longitudinally extending lift member supported at its longitudinal mid-portion through the utilization of an air bag assembly and each end of the lift member includes a stand slidable therealong and provided with a clamp assembly for clamp engaging a corresponding vehicle body side pinch weld area. Also, floor stands are provided for each end of the lift member and are slidably engageable therewith and anchorable relative to floor anchored rails between which the lift assembly extends.

13 Claims, 3 Drawing Sheets

2
3
5
10
12
14
16
18
20
22
28
30
32
34
36
38
40
42
44
46
48

UNIBODY LIFTING AND ANCHORING ASSEMBLY

BACKGROUND OF THE INVENTION

1. Field of the Invention

The present invention relates to a horizontally elongated assembly (to be used in pairs) for disposition transversely beneath a vehicle to be elevated from and rigidly supported above a floor or other work surface whereby pushing and pulling apparatuses may be connected between the floor and the vehicle for unibody and/or frame straightening purposes.

2. Description of Related Art

Various different forms of vehicle elevating structures for supporting a vehicle stationarily relative to a stationary support and preparatory to unibody and/or frame straightening operations heretofore have been designed as well as other structures including some of the general structural and operational features of the instant invention.

Examples of these previously known structures are disclosed in U.S. Pat. Nos. 3,754,427, 4,050,287, 4,087,895, 4,286,490, 4,323,141, 4,463,937, 4,603,570 and 4,605,203. However, these previously known structures do not incorporate the overall combination of structural features of the instant invention which greatly facilitate proper positioning of the lift structure relative to a vehicle to be elevated and rigidly supported relative to a work surface, stabilizing support of the lift structure in adjusted position relative to the work surface, ease of proper securement of an associated vehicle relative to the lift structure, and rigid anchoring of the lift structure relative to the support surface after an associated vehicle has been lifted thereby.

SUMMARY OF THE INVENTION

The vehicle lifting and anchoring structure of the instant invention has been specifically designed to lift a vehicle including unibody and/or vehicle frame portions which are to be straightened and to anchor the lifted vehicle relative to a work surface in a rigid and secure manner in order that push and pull developing apparatuses may be operatively connected between the work surface and the vehicle for straightening unibody and/or frame portions.

The main object of this invention is to provide a lift assembly for support from a floor surface and adjustable positioning thereover in a manner such that the lift assembly may be properly positioned relative to a vehicle to be lifted.

Another important object of this invention, in accordance with the preceding object, is to provide a lift assembly constructed in a manner enabling ready rigid attachment of the vehicle lifting portion of the lift assembly to a vehicle to be lifted.

Still another object of this invention is to provide a lift assembly capable of being shifted along a floor surface to accommodate a vehicle to be lifted positioned thereover and yet a lift assembly which is operatively associated with the floor assembly in a manner such that the base of the lift assembly is prevented from upset relative to the floor surface.

Yet another object of this invention is to provide a lift assembly in accordance with the preceding objects and incorporating support stand structure releasably engageable between the associated floor structure and the vehicle engaging and lifting portion of the lift assembly after a vehicle has been lifted in order to rigidly anchor the vehicle engaging and lifting portion of the lift assembly relative to the floor surface.

A final object of this invention to be specifically enumerated herein is to provide a lift assembly in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 7:
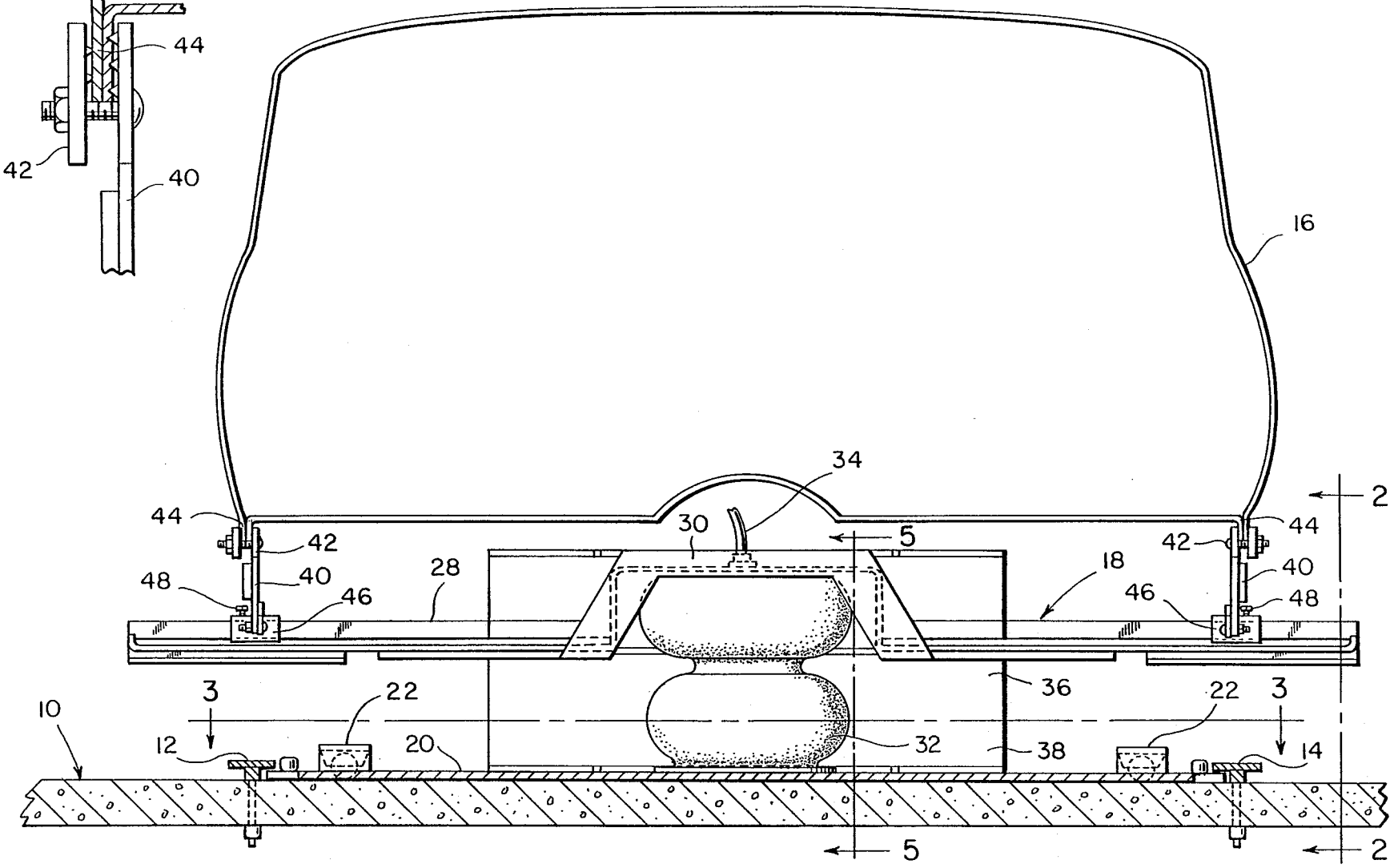
FIG. 1 is a fragmentary vertical sectional view taken through a support surface such as a floor and with the lift assembly of the instant invention illustrated mounted from the floor surface and in operative vehicle unibody engaging and supporting position with regard to a vehicle disposed over the floor surface, but with the rigid stand portions of the lift assembly omitted.
FIG. 7 is a fragmentary vertical sectional view illustrating the manner in which the clamp structures are operative to clampingly engage "pinch weld" areas of a unibody structure.
Figure 5:
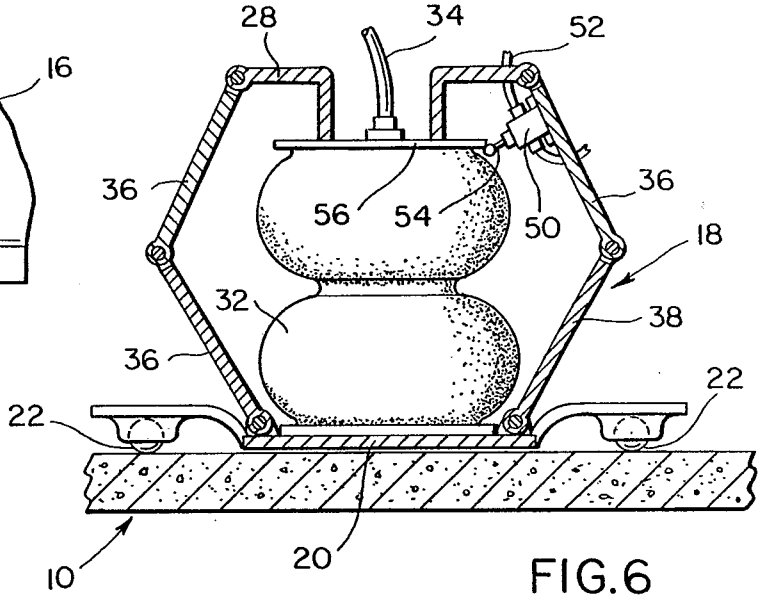
FIG. 5 is an enlarged fragmentary vertical sectional view taken substantially upon the plane indicated by the section line 5—5 of FIG. 1.

Referring now more specifically to the drawings, the numeral 10 generaly designates a reinforced floor construction comprising a work support surface and the floor construction includes a pair of parallel, elongated and generally T-shaped anchor rails 12 and 14 supported therefrom. A predetermined path of movement of a vehicle body 16 into position over the floor construction 10 is defined between the rails 12 and 14.

A vehicle body lifting and anchoring assembly constructed in accordance with the present invention is generally referred to by the reference numeral 18 and includes an elongated lower horizontal support member 20 disposed transverse to and between the anchor rails 12 and 14. The opposite ends of the support member 20 are slidably received between and beneath the adjacent marginal portions of the rails 12 and 14 and the opposite ends of the support member further include pairs of opposite side roller ball equipped support structures 22 whereby the assembly 18 may be readily laterally shifted along the anchor rails 12 and 14. In addition, the opposite ends of the support member 20 include laterally spaced rollers 24 for rollingly engaging the adjacent longitudinal edges of the anchor rails 12 and 14, thereby insuring that the support member 20 will be maintained substantially at right angles relative to the anchor rails 12 and 14.

It is to be noted that the support member 20 is constructed so as to be substantially rigid, but incorporating at least some resiliency, whereby when the assembly 18 is utilized to support the weight of the vehicle body 16 the longitudinal central portion of the support member 20 is deflected downward into tight frictional engagement with the floor construction 10.

The assembly 18 also includes a horizontally elongated lift member 28 above and paralleling the support member 20 and including an upwardly offset longitudinal mid-portion 30. An air bag assembly 32 is interposed between the longitudinal mid-portion 30 and the longitudinal mid-portion of the support member 20, the upper end of the air bag assembly 30 including a compressed air supply and vent line 34 operatively associated therewith whereby air under pressure may be controllably admitted to and vented from the interior of the air bag assembly 32.

In addition, the assembly 18 includes pairs of opposite side pivotally interconnected upper and lower guide plates 36 and 38 and the upper and lower margins of the plates 36 and 38 are pivotally mounted from the lift member 28 and support member 20, respectively. The guide plates 36 and 38 insure that the lift member 28, when elevated above the support member 20 through the utilization of the air bag assembly 32, is maintained substantially horizontal, but while the plates 36 and 38 are substantially rigid, they are at least somewhat resilient. Accordingly, when the lift member 28 is elevated relative to the support member 20 and has not yet been anchored to the vehicle body 16, the opposite ends of the lift member 28 may be downwardly or upwardly deflected as desired. However, when either end of the lift member 28 is upwardly or downwardly deflected, the guide plates 38 are at least slightly twisted about axes generally paralleling the lift member 28 and flexure of the guide plates 36 and 38 during this twisting action is increasingly resisted by the plates 36 and 38 as they are increasingly twisted.

Were it not for the guide plates 36 and 38, the lift member 28 would be biased toward a horizontal position only by the air bag assembly 32 and only slight upward and downward pressure on an end of the lift member 28 would be required to upwardly or downwardly deflect that lift member end. Also, the guide plates 36 and 38 prevent angular displacement of the lift member 28 about a central vertical axis relative to the support member 20.

Each end of the lift member 28 includes an upstanding support 40 which is adjustable in vertical extent and mounts a clamp assembly 42 from its upper end portion for clampingly engaging a corresponding pinch weld area 44 of the vehicle body 16 and rigidly supporting that pinch weld area from the support 40. The lower end of each support 40 includes a sleeve portion 46 slidably engaged with the corresponding end of the lift member 28 for adjustable positioning therealong and equipped with a set screw 48 for releasably anchoring the sleeve portion 46 in adjusted position on the lift member 28.

One of the plates 36 includes a control switch 50 interposed in an air line 52 operably connected with the line 34 and the switch 50 includes an actuator 54 engageable by the upper end plate 56 of the air bag assembly 32 when the lift member 28 has been elevated to its maximum desired position. Contact of the upper end plate 56 with the actuator 54 causes the control switch 50 to be actuated and terminates further supply of air under pressure to the air bag assembly 32 through the line 34.

Figure 2:
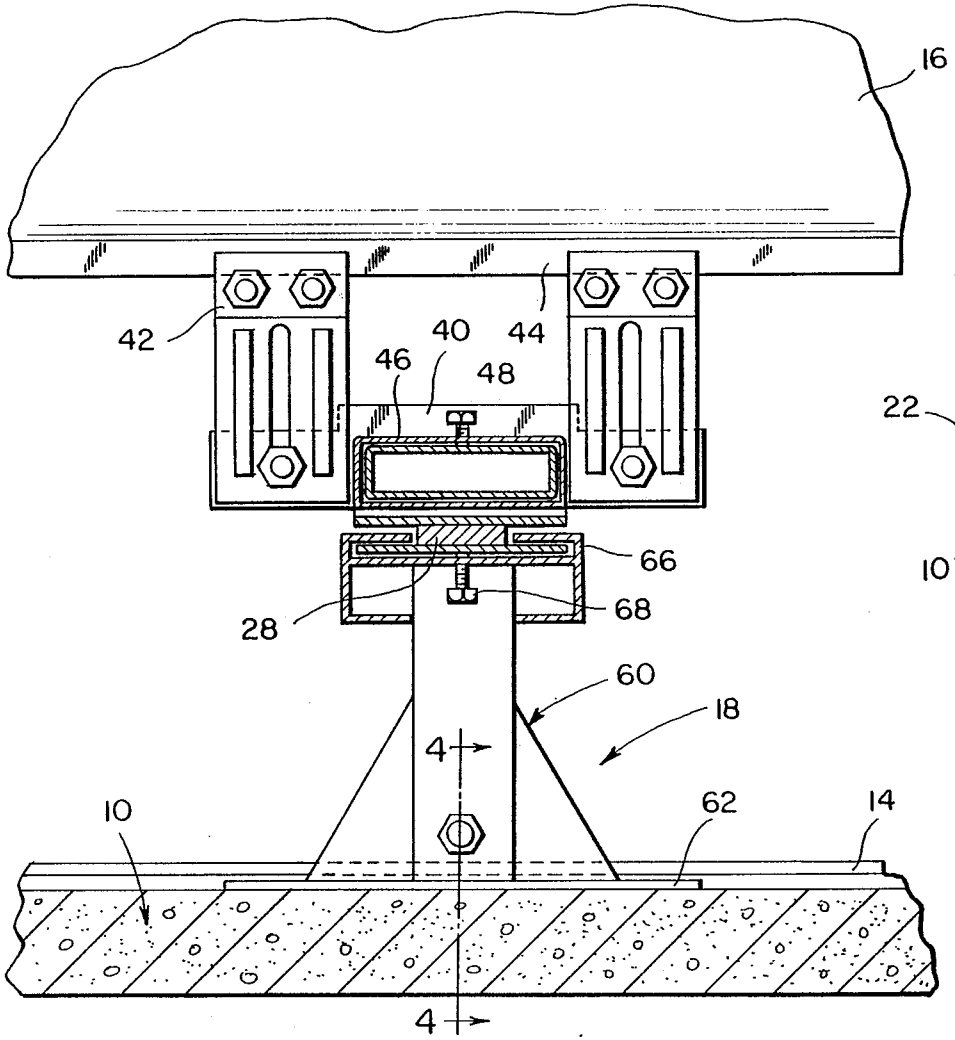
FIG. 2 is an enlarged fragmentary vertical sectional view taken substantially upon the plane indicated by the section line 2—2 of FIG. 1, but with the corresponding rigid stand portions shown.
Figure 3:
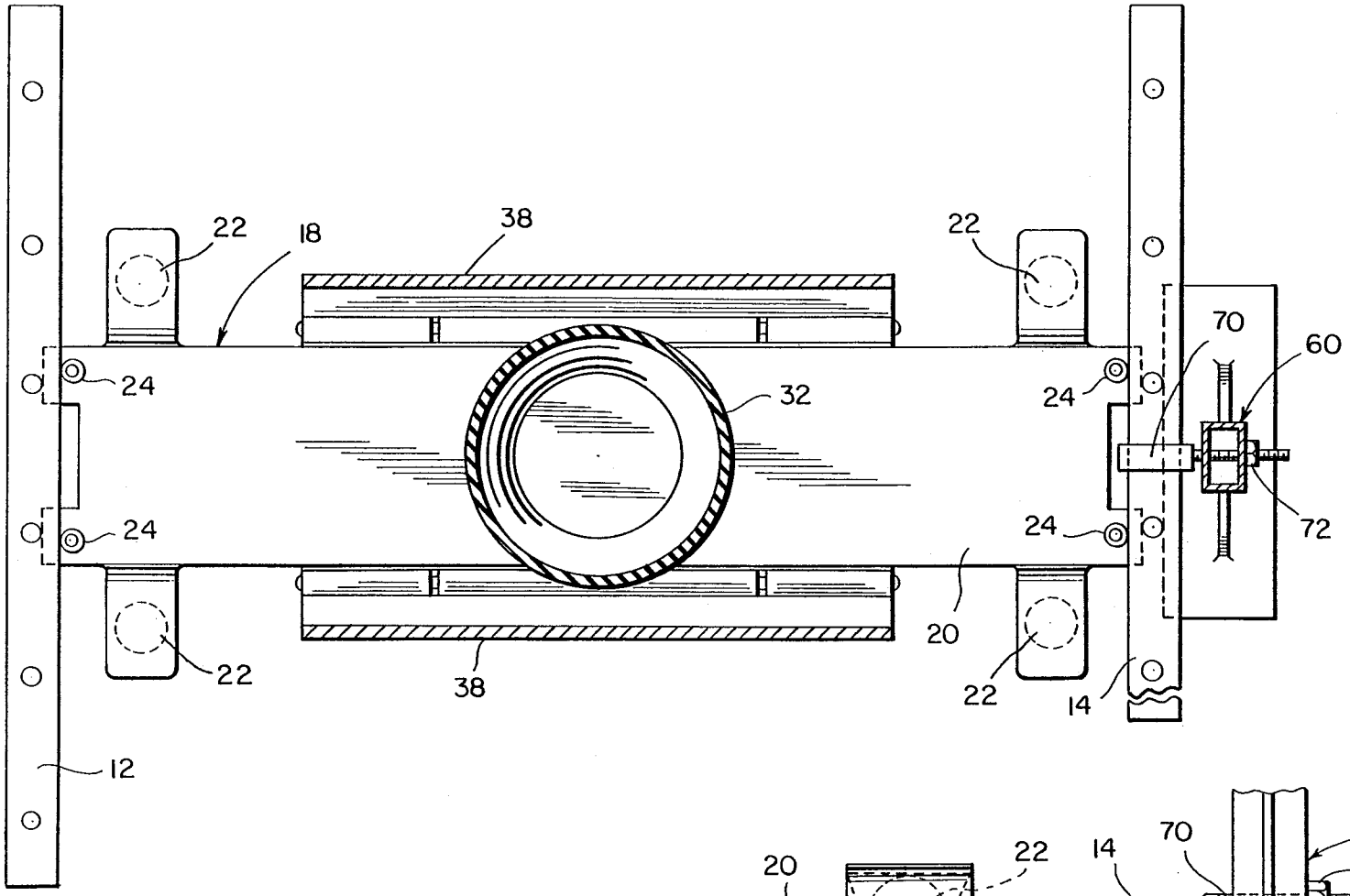
FIG. 3 is a horizontal sectional view taken substantially upon the plane indicated by the section line 3—3 of FIG. 1.
Figure 4:
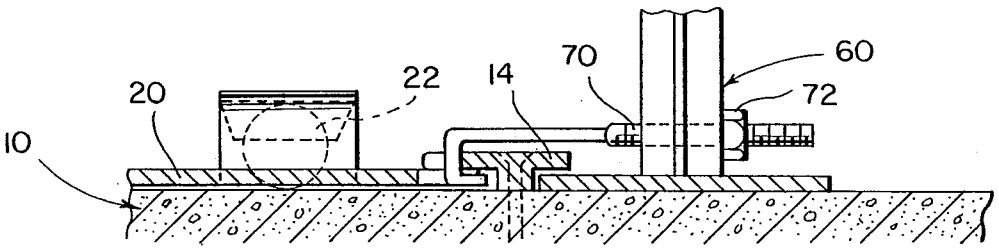
FIG. 4 is an enlarged fragmentary vertical sectional view taken substantially upon the plane indicated by the section line 4—4 of FIG. 2.

With attention now invited more specifically to FIGS. 2, 3 and 4 of the drawings, there may be seen a floor stand referred to in general by the reference number 60. A floor stand 60 is provided for each end of the lift member 28 and each floor stand 60 includes a base 62 supported from the floor 10 and engageable beneath the outer side of a corresponding anchor rail 12, 14. In addition, each floor stand 60 includes an upper channel portion 66 slidingly removably engageable with an associated end of the lift member 28 and each channel portion 66 includes a set screw 68 by which the channel portion 66 may be releasably locked in adjusted position relative to the corresponding member end. Also, each floor stand 60 includes a threaded anchor hook 70 equipped with a threaded nut 72 and each anchor hook 70 may be engaged over and under the inner side marginal portion of the corresponding rail 12, 14 and tightened relative to the floor stand 60 by the corresponding nut 72.

Figure 6:
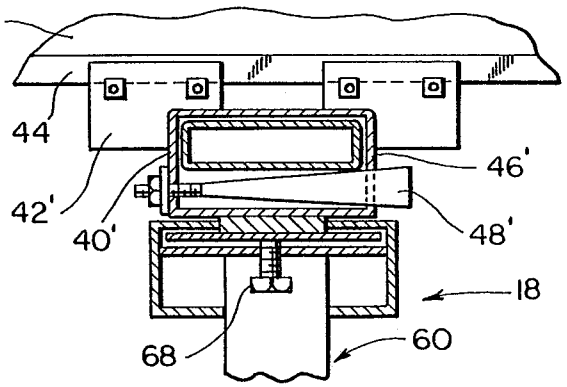
FIG. 6 is a fragmentary enlarged vergical sectional view similar to the upper portion of FIG. 2 and illustrating a modified wedge-type of clamp structure locking means.

With reference now more specifically to FIG. 6 of the drawings, a modified form of upstanding support referred to by the reference numeral 40' is illustrated including a modified form of clamp structure 42' and the upstanding support 40' incorporates a sleeve portion 46' corresponding to the sleeve portion 46 but which includes a wedge 48' in lieu of the set screw 48. Otherwise, the upstanding support 40' functions in a manner identical to the manner in which the support 40 functions.

In operation, the vehicle body 16 upon which straightening operations are to be performed is moved into position along the aforementioned predetermined path extending lengthwise between the anchor rails 12 and 14 and a lifting and anchoring assembly 18 is shifted along the rails 12 and. 14 at each end of the body 16 until the opposite ends of each lift member 28 are disposed beneath the pinch weld areas 44 at the corresponding torque boxes at that end of the vehicle body.

Thereafter, the sleeve portions 46 or 46' are positioned along the lift member 28 and the air bag assemblies 32 are simultaneously actuated to raise the lift member 28 to a height with the clamp structures 42 or 42' at substantially the pinch weld area 44. Then, the clamp structures 42 or 42' may be utilized to engage the pinch weld areas 44 and the air bag assemblies 32 may again be further actuated to elevate the vehicle body 16 to the desired working height. However, before the clamp assemblies 42 or 42' are clamp engaged with the pinch weld areas 44, the opposite ends of the lift member 28 may be downwardly deflected or upwardly deflected relative to the body 16 in order to facilitate proper positioning of the clamp assemblies 42 or 42' for clamp engagement with the pinch weld areas 44. In addition, the supports 40 are adjustable in effective vertical height.

After the lift member 28 has been raised to the predetermined height under the control of the switch or valve 50, the floor stands 60 may be engaged with and anchored relative to the opposite ends of the lift member 28 and the rails 12, 14 in the manner illustrated in FIG. 4. Of course, the set screws 68 and the set screws 48 or the wedges 48' are suitably tightened. Once the floor stands 60 are properly secured in position, the compressed air in the air bag assemblies 32 may be vented therefrom. After this has been accomplished, the vehicle body 16 is rigidly stationarily supported relative to the floor construction 10 and unibody and/or frame straightening operations may be readily performed on the vehicle body 16.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A vehicle body lifting and anchoring assembly for use upon a support surface over which a vehicle to be repaired may be moved along a predetermined path, said assembly being adapted to be used in pairs, including an elongated horizontal support member to be disposed transverse to said path, supported from said surface and adjustably laterally shiftable along said path over said surface, an elongated horizontal lift member disposed above and generally paralleling said support member, fluid operated lift means interposed between the longitudinal mid-portions of said members for elevating said lift member relative to said support member, upstanding supports adjustably guidingly mounted on opposite end portions of said lift member for independent adjustable shifting therealong and including upper end portion clamp structures for clamp engaging and supporting corresponding opposite side body pinch weld ares of a vehicle body positioned along said path and over said members, said lift means and lift member including coacting means supporting said lift member from said lift means for rocking relative to said support member about a horizontal axis disposed at generally right angles relative to said lift member.

2. The assembly of claim 1 wherein said fluid operated lift means comprises vertically extendable and retractable pneumatic air bag means.

3. The assembly of claim 2 wherein said lift member includes an upwardly offset mid-portion between which and the longitudinal mid-portion of said support member said air bag means is connected.

4. The assembly of claim 2 including anti-rocking means connected between said support member and lift member yieldingly resisting rocking of said lift member relative to said support member.

5. The assembly of claim 4 wherein said anti-rocking means includes means operative to progressively yieldingly resist rocking of said lift member relative to said support member from a predetermined position disposed substantially parallel to said support member.

6. The assembly of claim 4 wherein said anti-rocking means includes means operatively associated with said lift means for automatically limiting upward movement of said lift member relative to said support member by said lift means.

7. The assembly of claim 2 wherein said lift member and supports include coacting lock means operable to releasably lock said supports in adjusted shifted positions along said lift member.

8. The assembly of claim 7 wherein said supports each include means operative to adjust the effective height thereof.

9. The assembly of claim 7 wherein said lock means includes set screw means operatively associated with said supports and lift member.

10. The assembly of claim 7 wherein said lock means includes wedge means operatively associated with said supports and lift member.

11. A vehicle body lifting and anchoring assembly for use upon a support surface over which a vehicle to be repaired may be moved along a predetermined path, said assembly being adapted to be used in pairs, including an elongated horizontal support member to be disposed transverse to said path, supported from said surface and adjustably laterally shiftable along said path over side surface, an elongated horizontal lift member disposed above and generally paralleling said support member, fluid operated lift means interposed between the longitudinal mid-portions of said members for elevating said lift member relative to said support member, upstanding supports adjustably guidingly mounted on opposite end portions of said lift member for independent adjustable shifting therealong and including upper end portion clamp structures for clamp engaging and supporting corresponding opposite side body pinch weld area of a vehicle body positioned along said path and over said members, said lift means and lift member including coacting means supporting said lift member from said lift means for rocking relative to said support member about a horizontal axis disposed at generally right angles relative to said lift member, a floor surface comprising said support surface and upon which said predetermined path is defined, a pair of parallel anchor rails anchored relative to said surface and disposed on opposite sides of and generally paralleling said path, said support member being shiftable transversely over said floor surface along and between said rails, said support member including pairs of opposite end guide portions spaced on opposite sides of the medial vertical plane of said support member guidingly associated with said rails against angular displacement of said support member about its longitudinal center axis relative to said rails.

12. The assembly of claim 11 including a pair of floor stands for support from and shifting along said floor surface and rails and slidably and guidingly engaged with opposite end portions of said lift member for adjustable positioning along and against angular displacement of said lift member about its longitudinal axis relative to said stands.

13. A vehicle body lifting and anchoring assembly for use upon a support surface over which a vehicle to be repaired may be moved along a predetermined path, said assembly being adapted to be used in pairs, including an elongated horizontal support member to be disposed transverse to said path, supported from said surface and adjustably laterally shiftable along said path over said surface, an elongated horizontal lift member disposed above and generally paralleling said support member, fluid operated lift means interposed between the longitudinal mid-portions of said members for elevating said lift member relative to said support member, upstanding supports adjustably guidingly mounted on opposite end portions of said lift member for independent adjustable shifting therelong and including upper end portion clamp structures for clamp engaging and supporting corresponding opposite side body pinch weld areas of a vehicle body positioned along said path and over said members, a floor surface comprising said support surface and upon which said predetermined path is defined, a pair of parallel anchor rails anchored relative to said surface and disposed on opposite sides of and generally paralleling said path, said support member being shiftable transversely over said floor surface, along and between said rails, a pair of floor stands for support from and shifting along said floor surface and rails and slidably and guidingly engaged with opposite end portions of said lift member for adjustable positioning along and against angular displacement of said lift member about its longitudinal axis relative to said stands, said stands including anchor means releasably anchorable relative to said anchor rails.

* * * * *